US006019531A

United States Patent [19]

Henderson et al.

[11] Patent Number: 6,019,531

[45] Date of Patent: Feb. 1, 2000

[54] GAPLESS LABEL MEDIA AND PRINTING APPARATUS FOR HANDLING SAME

[75] Inventors: Thomas A. Henderson, Clarksville, Ohio; Thomas A. Sweet, Everett; Joel A. Schoen, Woodinville, both of Wash.

[73] Assignee: Intermec IP Corp., Woodland Hills, Calif.

[21] Appl. No.: 09/174,639

[22] Filed: Oct. 19, 1998

Related U.S. Application Data

[60] Division of application No. 08/824,961, Mar. 27, 1997, Pat. No. 5,823,693, which is a continuation-in-part of application No. 08/566,423, Nov. 30, 1995, abandoned.

[51] Int. Cl.[7] ..... B41J 11/26

[52] U.S. Cl. ..... 400/611; 400/708; 400/619; 400/582; 250/559.6

[58] Field of Search ..... 400/611, 615.2, 400/619, 582, 708, 708.1; 101/288; 250/559.6

[56] References Cited

U.S. PATENT DOCUMENTS

| | | | |
|---|---|---|---|
| 4,264,396 | 4/1981 | Stewart . | |
| 4,311,399 | 1/1982 | Wegryn et al. . | |
| 4,480,933 | 11/1984 | Shibayama et al. | 400/615.2 |
| 4,544,287 | 10/1985 | Teraoka . | |
| 4,591,969 | 5/1986 | Bloom et al. . | |
| 4,661,001 | 4/1987 | Takai et al. . | |
| 4,680,078 | 7/1987 | Vanderpool et al. . | |
| 4,699,531 | 10/1987 | Ulinski, Sr. et al. . | |
| 4,795,281 | 1/1989 | Ulinski, Sr. et al. . | |
| 4,844,629 | 7/1989 | Hoyt . | |
| 4,920,882 | 5/1990 | Hoyt . | |
| 4,936,693 | 6/1990 | Ohsawa . | |
| 4,960,336 | 10/1990 | Brooks et al. . | |
| 5,056,429 | 10/1991 | Hirosaki . | |
| 5,061,946 | 10/1991 | Helmbold et al. . | |
| 5,061,947 | 10/1991 | Morrison et al. . | |
| 5,179,390 | 1/1993 | Yokoyama et al. | 400/619 |
| 5,322,380 | 6/1994 | Crocker . | |
| 5,335,837 | 8/1994 | Saeki et al. . | |
| 5,431,763 | 7/1995 | Bradshaw . | |
| 5,480,244 | 1/1996 | Senda | 400/582 |
| 5,492,423 | 2/1996 | Smith . | |
| 5,498,087 | 3/1996 | Wey et al. . | |
| 5,517,915 | 5/1996 | Oshino et al. . | |
| 5,524,996 | 6/1996 | Carpenter et al. . | |
| 5,541,626 | 7/1996 | Hiramatsu et al. . | |
| 5,564,846 | 10/1996 | Katsumata . | |
| 5,676,479 | 10/1997 | Yamaguchi et al. | 400/582 |
| 5,915,864 | 6/1999 | Austin et al. | 101/288 |

FOREIGN PATENT DOCUMENTS

| | | |
|---|---|---|
| 55-32603 | 3/1980 | Japan . |
| 56-169688 | 7/1983 | Japan . |
| 60-187570 | 9/1985 | Japan . |
| 2-305666 | 12/1990 | Japan . |

*Primary Examiner*—Eugene Eickholt
*Attorney, Agent, or Firm*—O'Melveny & Myers LLP

[57] ABSTRACT

A gapless label media which can be carried by a liner or be linerless. Apparatus is also disclosed for printing on and applying resultant labels which are staggered laterally across the media width. In an embodiment of the invention, the label printer comprises a printhead for printing on the media, a sensor sensing the leading edge of each first label at a known distance from the printhead, and a drive system moving the plurality of labels from a position of the sensor to a pre-established print position under the printhead. In another embodiment of the present invention, in which there may be lateral drift of the labels, the sensor senses along a path having a width greater than a maximum amount of lateral drift of the plurality of labels. Alternatively, plural sensors may be utilized to detect plural paths through the labels to detect lateral drift of the labels, or to detect alternating ones of the labels.

24 Claims, 10 Drawing Sheets

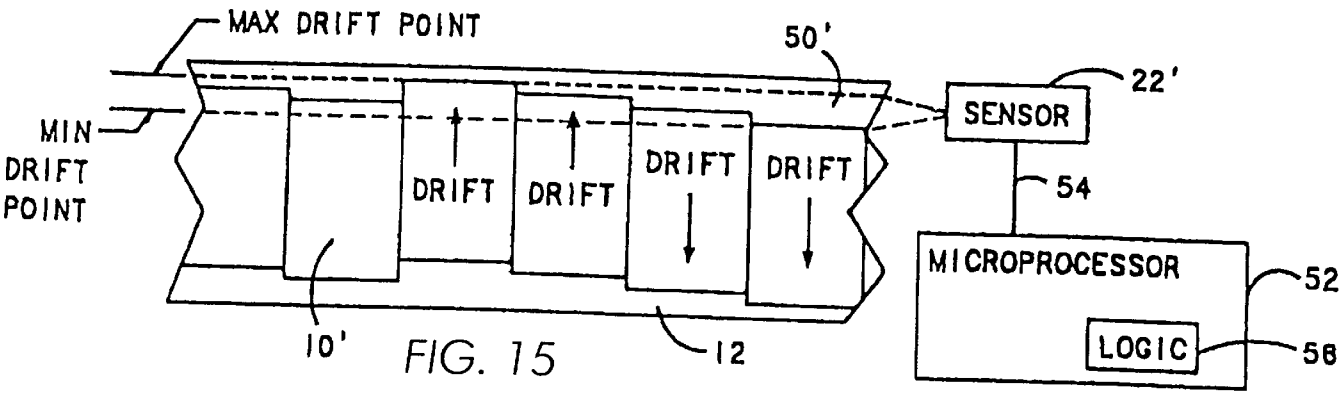
FIG. 15
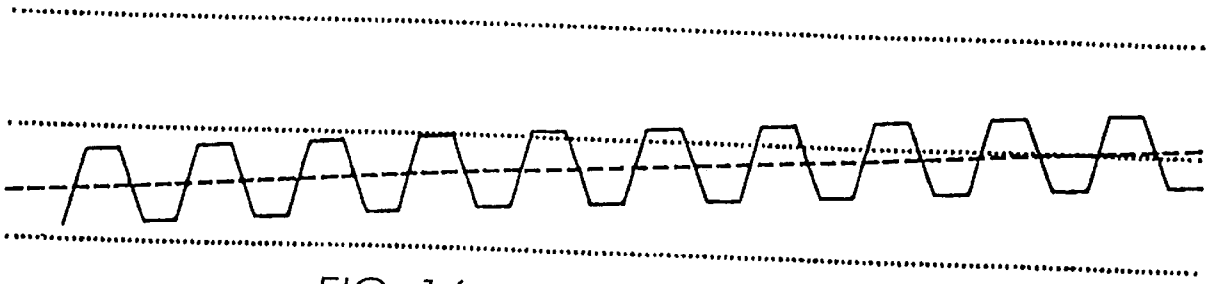
FIG. 16
$$E = \frac{B - A - \frac{C-A}{2}}{2}$$
FIG. 17

GAPLESS LABEL MEDIA AND PRINTING APPARATUS FOR HANDLING SAME

RELATED APPLICATION

This application is a division of application Ser. No. 08/824,961, filed Mar. 27, 1997, now issued on Oct. 20, 1998, as U.S. Pat. No. 5,823,693; which is a continuation-in-part application of Ser. No. 08/566,423, filed Nov. 30, 1995, now abandoned.

BACKGROUND OF THE INVENTION

1. Field of the Invention

This invention relates to strip, backed, label media and, more particularly, to a gapless label media comprising a strip of media having a plurality of labels with leading and trailing edges abutting one another, the plurality of labels comprising a plurality of sequences of equal numbers of the labels with a first label of each sequence of the labels having a leading edge which is sensible. The invention also relates to methods and apparatus for printing on and applying labels which are staggered laterally across a media width.

2. Description of Related Art

In the prior art, labels 10 for printing on by one-at-a-time demand printers often come releasibly attached to a backing strip 12 as shown in FIG. 1. The backing strip 12 is moved from a supply roll (not shown) to the printhead 14 by a drive system 16 under the control of position and print logic 18. The labels 10 are positioned along a line running down the backing strip 12 so as to be equally laterally positioned under the printhead 14. There is also an equal gap 20 between the labels 10. The drive system 16 includes a stepping motor (not shown) which moves the backing strip 12 along at a constant rate. A sensor 22 connected to the position and print logic 18 senses the leading edge 24 of each label 10 at a known distance from the printhead 14. From the time the leading edge 24 is sensed, the position and print logic 18 counts the pulses of the stepping motor until it knows that the label 10 is positioned under the printhead 14 for printing. At that point, the position and print logic 18 starts printing the label with the printhead 14. With the gaps 20 between the labels 10, the sensor 22 can sense the leading edge 24 by the changes in light transmission between the backing strip 12 alone and the backing strip 12 in combination with the label 10; or, the difference in thickness or height that occurs at the leading edge 24 can be physically sensed. In the alternative, a hole 26 can be provided in the backing strip 12 in a known relationship to the leading edge 24.

In a so-called "gapless" label media 28 as depicted in FIG. 2, the labels 10 follow one behind the other on the backing strip 12 and there is no gap 20 to allow sensing of the leading edge 24. That is, the leading edge 24 of one label 10 is in the same position as the trailing edge 25 of the label 10 directly preceding it. The only prior art sensing approach available is the hole 26 in the backing strip 12. More recent developments in label technology can make the hole-in-the-backing-strip approach unusable. For example, in so-called "linerless" media, there is no backing strip. The labels 10 are continuous and are severed one from another after printing (or possibly before). In the case of pre-printed labels having standard sender information pre-printed thereon, there is a de facto "leading edge" that must be repeatably positioned under the printhead 14.

With the advent of printer dot resolutions on the order of 300 dots per inch (dpi) and higher, smaller printing is possible. Since it is desirable to put small labels on small electronic components and the like, there has been a simultaneous trend towards printing smaller labels. With small labels in particular, but with all labels in general, the provision of the gaps 20 adds to the manufacturing costs and wastes materials.

Wherefore, it is an object of this invention to provide a gapless label media which is sensible as to the position of leading edges of the individual labels thereof.

It is another object of this invention to provide a gapless label media which is sensible as to the position of leading edges of the individual labels thereof even in a linerless form.

It is still another object of this invention to provide methods and apparatus for positioning and printing on a gapless label media wherein the position of leading edges of the individual labels thereof is not sensible at every label position.

It is yet another object of this invention to provide methods and apparatus for positioning and printing on a gapless label media wherein the lateral position of the individual labels thereof is not consistent.

It is a further object of this invention to provide methods and apparatus for printing on a staggered label media and thereafter properly applying the printed labels to a desired position on an object.

Other objects and benefits of this invention will become apparent from the description which follows hereinafter when read in conjunction with the drawing figures which accompany it.

SUMMARY OF THE INVENTION

The label printer/applier of the present invention provides for printing label data on labels of a strip of label media having a plurality of laterally staggered labels in a plurality of sequences of the labels with a first label of each sequence of the labels having a leading edge which is sensible and thereafter applying printed labels on a surface at lateral positions corrected for staggering. The labels can be either gapped or gapless and carried by a liner or linerless.

In an embodiment of the invention, the label printer/applier comprises a printhead for printing on the media, a sensor sensing the leading edge of each first label at a known distance from the printhead, and a drive system moving the plurality of labels from a position of the sensor to a pre-established print position under the printhead (which may be in a plurality of equal sized steps). A label attaching mechanism is adapted to receive printed labels from the printhead. The label attaching mechanism is laterally movable a distance equal to an offset width of the common pattern of staggering. The label printer/applier further comprises a shifting mechanism having a signal input shifting the label attaching mechanism laterally a distance and amount dictated by a signal at the signal input.

Position and print logic is provided in the label printer/applier to 1) sense each first label of each sequence of labels with the sensor, 2) move a next in sequence label from the position of the sensor to the pre-established print position under the printhead, 3) print label data on labels positioned under the printhead, and 4) output a signal to the signal input indicating the lateral position of a label positioned at the label attaching mechanism for attachment to a surface whereby the label is properly positioned laterally on the surface to compensate for its lateral offset in the common pattern of staggering. The printer portion can also be employed without the applier portion.

In another embodiment of the present invention, in which there may be lateral drift of the labels, the sensor senses along a path having a width greater than a maximum amount of lateral drift of the plurality of labels. The position and print logic may also include logic for calculating a compensation factor E according to the equation:

$$E = \frac{(B-A) - \frac{(C-A)}{2}}{2}$$

where:

A=position of a detected leading edge of a label;

B=position of a detected trailing edge of a label or a leading edge of an offset label; and C=position of a detected leading edge of a following label.

A corrected position for the leading edges of the labels may then be determined from the equations: A'=A+E and B'=B−E, where:

A'=calculated leading edge of a label, after correction; and

B'=calculated leading edge of an offset label, after correction.

In another embodiment of the invention, each sequence of labels is equally laterally staggered across a width of the strip of gapless label media in a common pattern of staggering so that the first label of each sequence of labels has at least a portion thereof creating an offset leading edge which is physically sensible. The printhead comprises a printing area extending across the width of the strip of gapless media. The printing area is subdivided into sub-printing areas equal to a width and positioned over a lateral position of one label of each sequence of labels. The printhead may comprise a thermal printhead having a plurality of adjacent heating elements across the printing area, in which the sub-printing areas each comprises an equal number of adjacent ones of the heating elements. Alternatively, the printhead may comprise an impact printhead carried across a path defining the printing area from one end thereof to an opposite end, and each of the sub-printing areas comprise a portion of the path.

DESCRIPTION OF THE DRAWINGS

FIG. 15 is a simplified drawing of a sensing approach according to the present invention for sensing staggered labels when lateral drift is possible;

FIG. 16 depicts sensor signal versus tape motion, showing the optical effect of lateral drift;

FIG. 17 is an equation for use in a preferred embodiment of the present invention;

DETAILED DESCRIPTION OF THE PREFERRED EMBODIMENTS

This invention satisfies the need for an apparatus an method for positioning and printing on a gapless label media. In the detailed description that follows, like element numerals are used to describe like elements illustrated in one or more of the figures.

Figure 1:
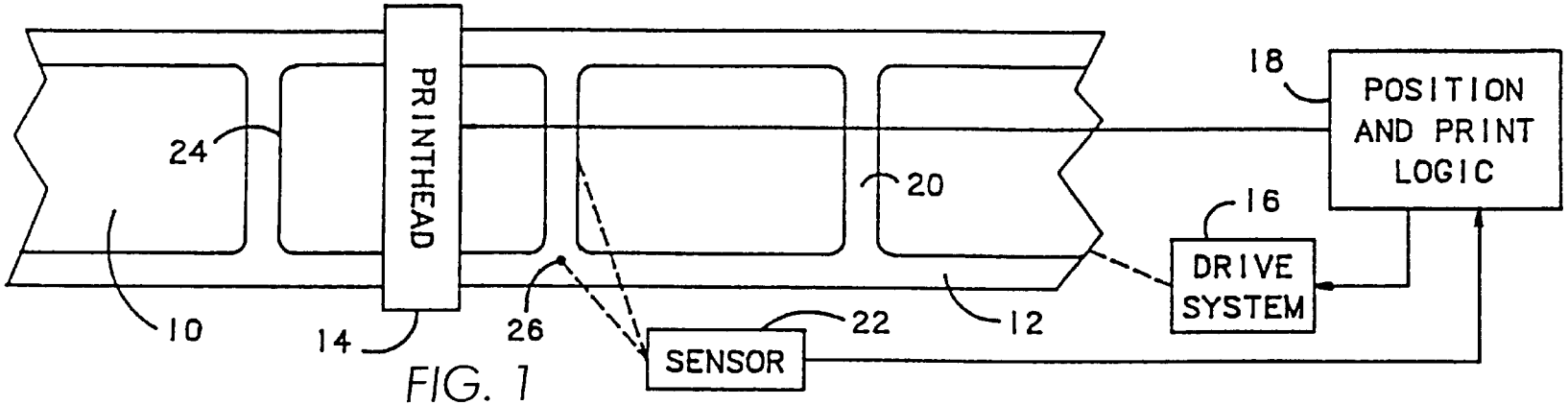
FIG. 1 (PRIOR ART)
FIG. 1 is a simplified drawing of printing apparatus printing on a gapped label media strip showing prior art techniques for sensing the label positions.
Figure 2:
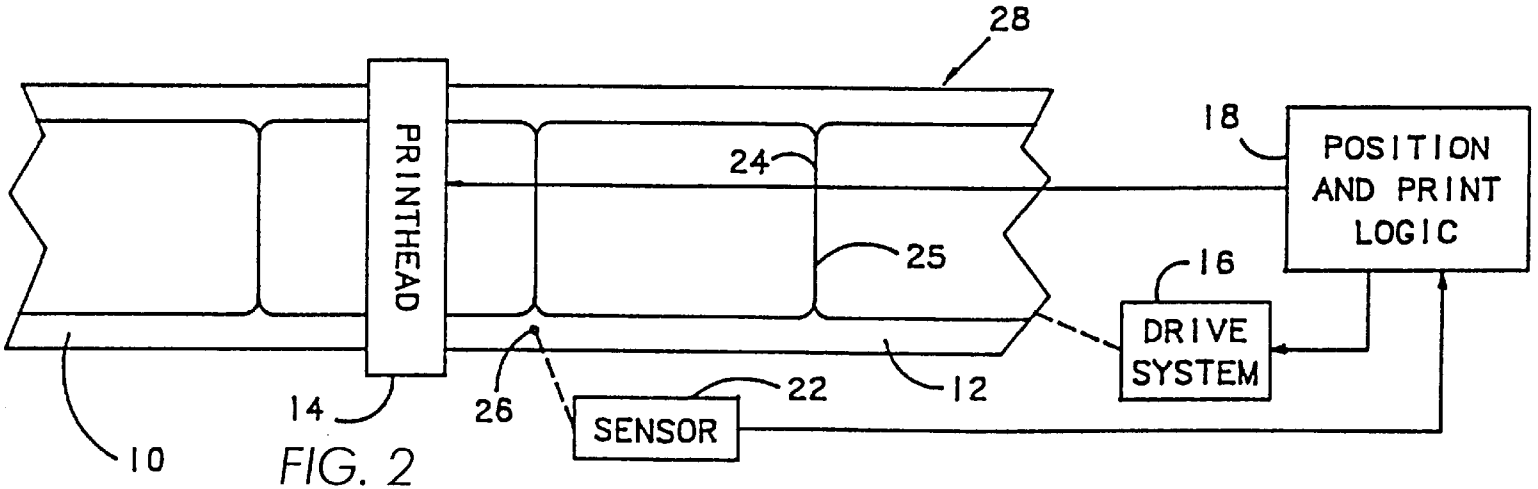
FIG. 2 (PRIOR ART)
FIG. 2 is a simplified drawing of printing apparatus printing on a gapless label media strip showing prior art techniques for sensing the label positions.
Figure 3:
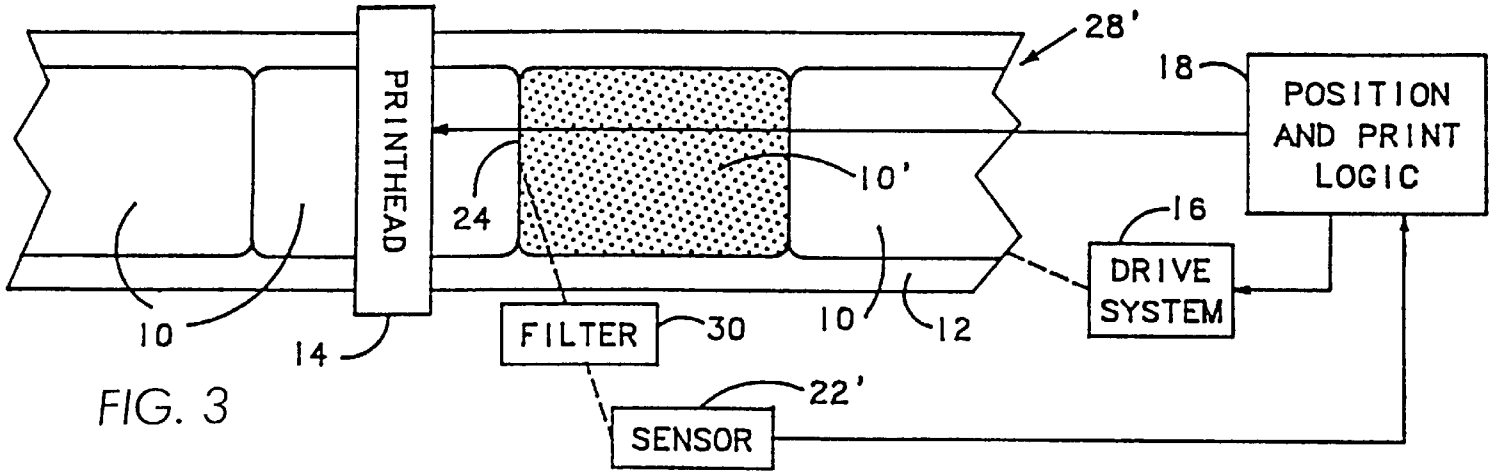
FIG. 3 is a simplified drawing of printing apparatus printing on a gapless label media strip showing a first embodiment of the present invention for sensing the label positions.

Referring first to FIG. 3, a first embodiment of gapless media 28' according to the present invention is illustrated. The depicted embodiment has a backing strip 12 and the individual labels 10 are pre-cut. Note that the embodiment would work equally well with linerless media. In this embodiment, certain labels 10', at least adjacent their leading edge 24, are made optically sensible. For example, the surface of the label 10' could be colored with a different color uniquely detectable by the sensor 22' through an appropriate filter 30; or, coated with a fluorescent material that would be uniquely detectable by the sensor 22' under a stimulating light source.

Note that in order to be detectable, only selected ones of the labels 10' can be unique. This means that in the extreme case, every other label 10 is a sensible label 10'. But, if desired, every third label 10, fourth label 10, or the like, could be the sensible label 10'. In so doing, however, the position and print logic 18 must be changed to properly position the labels 10,10' under the printhead 14 for printing. Exemplary logic 32 to accomplish the requirements is shown in flowchart form in FIG. 4. In decision block 4.1, the logic 32 looks for the leading edge 24 to be sensed by the sensor 22'. When it is sensed, the sequence counter 34 is reset indicating that the first label 10' of a label sequence has been sensed. As mentioned above, the sequence may comprise two, three, or more, labels 10,10'. Actually, the limiting factor will be the slippage factor in the printer. As is known and described in detail in other co-pending applications assigned to the common assignee hereof, slippage in the drive system 16 will dynamically occur during printing. Thus, there are checking procedures that can take place to sense any slippage and adjust the number of equal-sized steps of the stepping motor of the drive system 16 to put the longitudinal top-of-form registration of the labels 10 back within tolerance limits. As the labels 10 get smaller, in general, the amount of checking should increase since tolerances will have to be smaller. Thus, with extremely small labels, one would probably want to tend more towards having every other label 10 be a sensible label 10'.

When the first label 10' of the label sequence has been sensed and the sequence counter 34 reset, at block 4.3 the first label 10' is moved the proper number of steps of the stepping motor in the drive system 16 to place it in proper longitudinal top-of-form registration with respect to the printhead 14. If every other label 10 is being sensed, then the steps between sensings will be two times that required to position one label 10. Thus, the logic 32 contained in the position and print logic 18 will step the stepping motor one-half that number of steps. If every third label 10 was the sensible label 10', the number of steps calculated would be three times the required number for one label 10 and the logic 32 would step the stepping motor one-third that number of steps. When the first label 10' is in position under the printhead 14, the logic 32 at block 4.4 causes the label 10' to be printed, and then at block 4.5 the sequence counter 34 is incremented by one. The logic 32 then returns to block 4.1. If the edge has not been sensed at decision block 4.1, the logic 32 moves to decision block 4.6 where the logic 32 checks to see if the last label 10 of the sequence has been printed. If it has not, the logic 32 moves to block 4.7 which moves the next label 10 of the sequence under the printhead 14 and then goes to block 4.4.

As those of ordinary skill in the art will recognize and appreciate, blocks 4.3 and 4.7 are duplicate functions under most circumstances. If they are, in fact, duplicates, they could be combined in the same path with block 4.4. As depicted, however, blocks 4.3 and 4.7 permit the first label 10' of the sequence to be different from the remaining labels 10, if such is desirable. For example, there may be label pairs where the first and second labels are of different length or initial positioning. In that example, the actions taken by blocks 4.3 and 4.7 could be made different. As will be appreciated, if the sequence counter 34 is not being used for any particular purpose, the sequence counter and the logic of blocks 4.2 and 4.4 can be eliminated.

Figure 4:
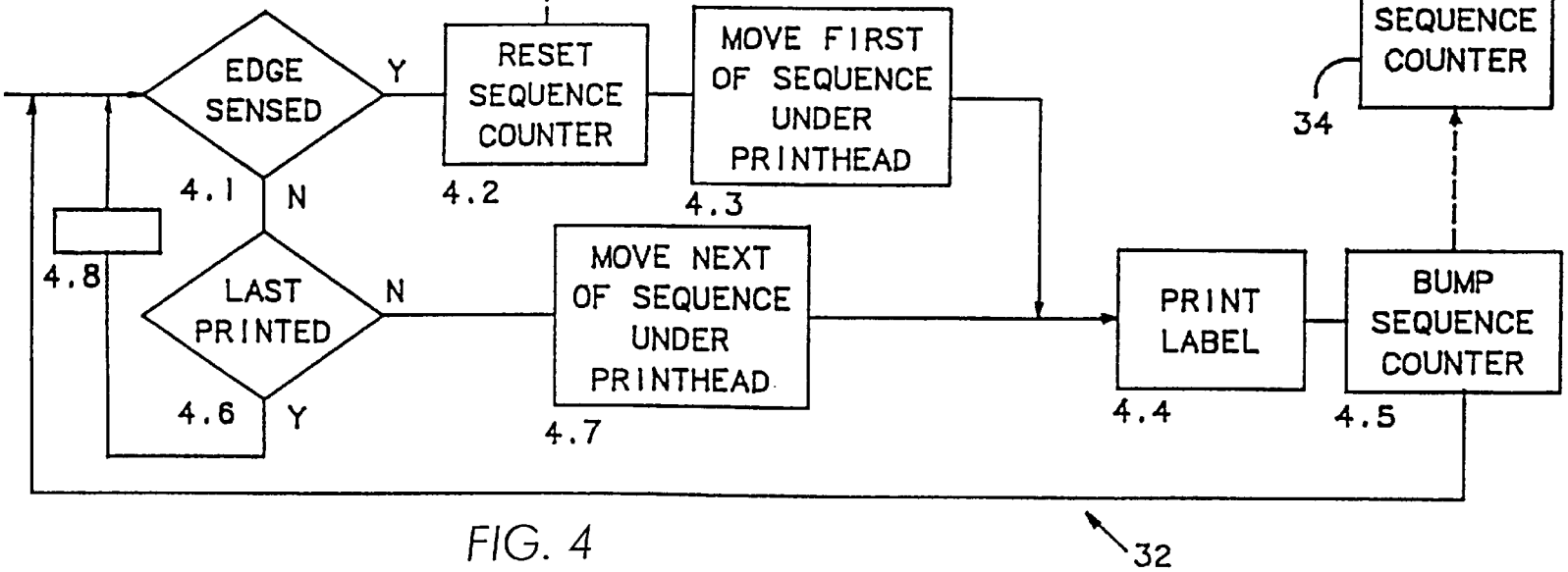
FIG. 4 is a flowchart of exemplary logic according to the present invention for positioning and printing on the labels of FIG. 3.

Other aspects of the logic 32 of FIG. 4 are also arbitrary and shown for a complete disclosure only and to show aspects considered by the inventors herein and intended to be included within the scope and spirit of the invention and the breadth of the claims appended hereto. For example, decision block 4.6 that indicates that if the last label 10 in the sequence has been printed, the logic 32 returns to decision block 4.1 to wait in a loop for an edge to be sensed, i.e., the next sensible label 10' to be found. As those of ordinary skill in the art undoubtedly recognized, the logic 32 should never get to the "yes" path of decision block 4.6 under most circumstances. Basically, decision block 4.6 is an error path provided for such purpose. For example, if the number of labels 10,10' of the label sequence to be printed by the printer employing the logic 32 will be variable, provision will be made to change the maximum value of the sequence counter 34 since that value is used to calculate the number of steps to drive the stepping motor of the drive system 16 in order to position a next label 10 under the printhead 14 as described above. In that case, if the "yes" path is taken out of decision block 4.6, undesignated block 4.8 in the path back to decision block 4.1 could provide an error routine that stopped the printing process and informed the operator that the printer was mis-aligning the labels 10.

Figure 5:
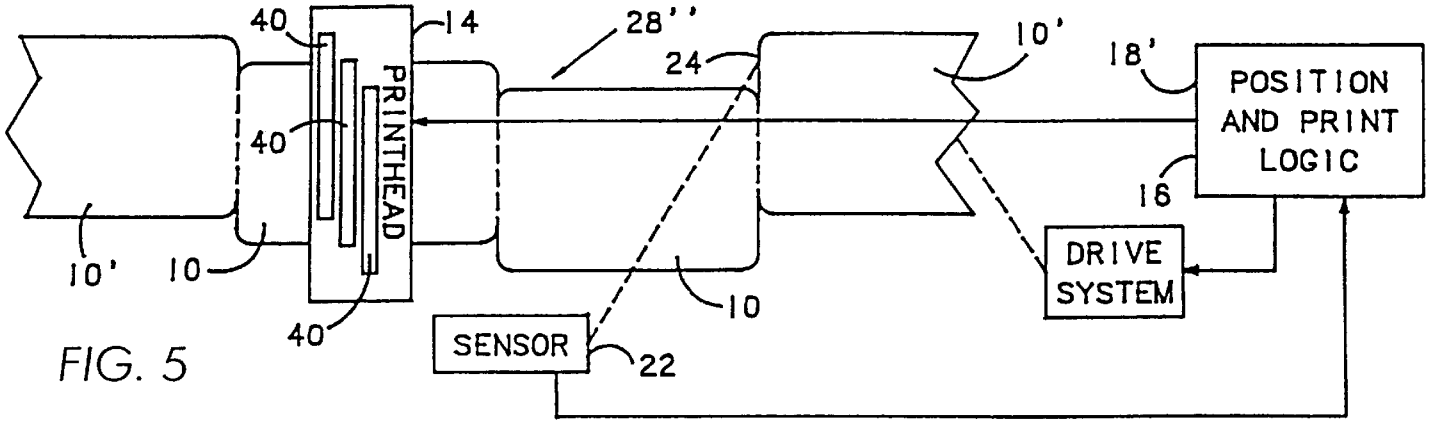
FIG. 5 is a simplified drawing of printing apparatus printing on a gapless label media strip showing a second embodiment of the present invention for sensing the label positions.

FIG. 5 depicts a second embodiment of gapless media 28" according to the present invention. The depicted embodiment is linerless, meaning that it has no backing strip and the individual labels 10 are not pre-cut. As with the first embodiment, this embodiment would work equally well with the opposite configuration, i.e., media having a backing strip 12 and pre-cut labels 10. In this embodiment, the labels 10 are laterally staggered thus providing an actual partial leading edge 24 of a first label 10' which is sensible by a standard sensor 22. In the depicted embodiment, there are three labels 10',10 in each label sequence; but, there could be as few as two and as many as desired depending on the size of the labels (i.e., the space available for a physical offset that is detectable) and the slippage considerations of the printer described above with respect to the first example.

Figure 6:
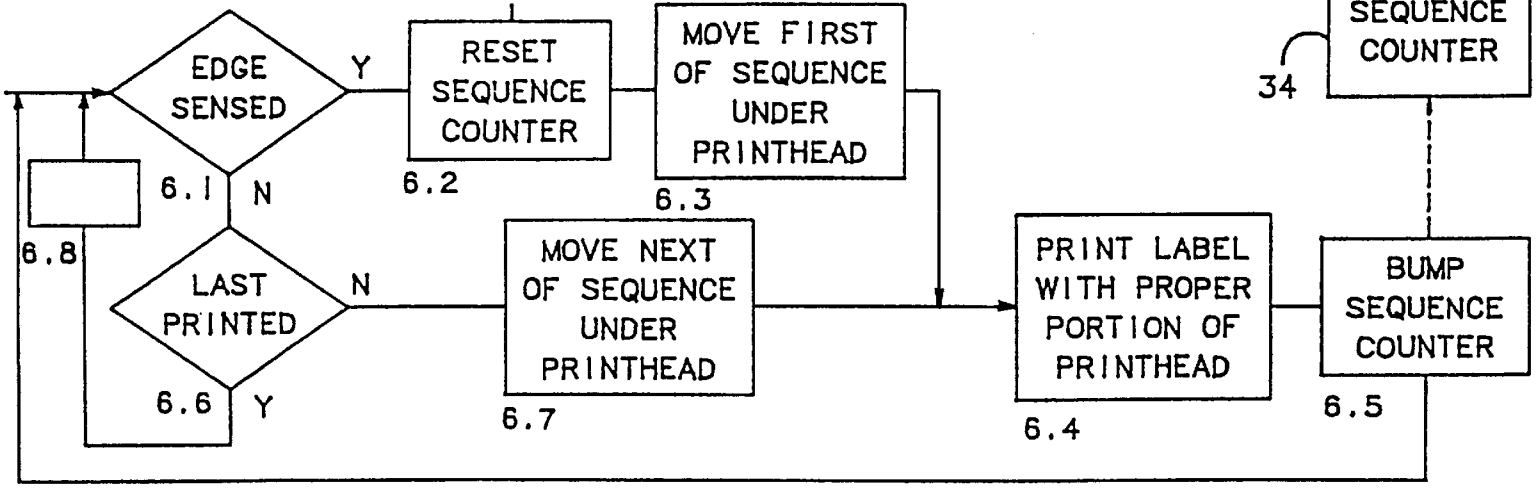
FIG. 6 is a flowchart of exemplary logic according to the present invention for positioning and printing on the labels of FIG. 5.

Exemplary logic 32' to accomplish the requirements of this embodiment is shown in flowchart form in FIG. 6. In decision block 6.1, the logic 32' looks for the partial leading edge 24 to be sensed by the sensor 22. When it is sensed, the sequence counter 34 is reset indicating that the first label 10' of a label sequence has been sensed. Note that for reasons that will be seen shortly, the sequence counter 34 is required in this embodiment and is not optional as in the prior embodiment. When the first label 10' of the label sequence has been sensed and the sequence counter 34 reset, at block 6.3 the first label 10' is moved the proper number of steps of the stepping motor in the drive system 16 to place it in proper longitudinal top-of-form registration with respect to the printhead 16. Again by way of example, if every other label 10 is being sensed, then the steps between sensings will be two times that required to position one label 10. Thus, the logic 32' contained in the position and print logic 18 will step the stepping motor one-half that number of steps. When the first label 10' is in position under the printhead 14, the logic 32' at block 6.4 causes the label 10' to be printed, and then at block 6.5 the sequence counter 34 is incremented by one. The logic 32' then returns to block 6.1. We will return to the specifics of block 6.4 in a moment. For now, if the edge has not been sensed at decision block 6.1, the logic 32' moves to decision block 6.6 where the logic 32' checks to see if the last label 10 of the sequence has been printed. If it has not, the logic 32' moves to block 6.7 which causes the next label 10 of the sequence to be moved under the printhead 14, and then the logic goes to block 6.6.

As in the prior embodiment, blocks 6.3 and 6.7 will be duplicate functions under most circumstances; and, if they are, they can be combined in the same path with block 6.6. And, as depicted, they again provide for the first label 10' of the sequence to be different from the remaining labels 10, if such is desirable. Also, once again, the logic 32' should never reach the "yes" path of decision block 6.6 under most circumstances as it is an error path provided for such purpose that can be used in substantially the same manner as described above. That is, if the "yes" path is taken out of decision block 6.6, undesignated block 6.7 in the path back to decision block 6.1 could be an error routine that stops the printing process and informs the operator that the printer is mis-aligning the labels 10.

Figure 7:
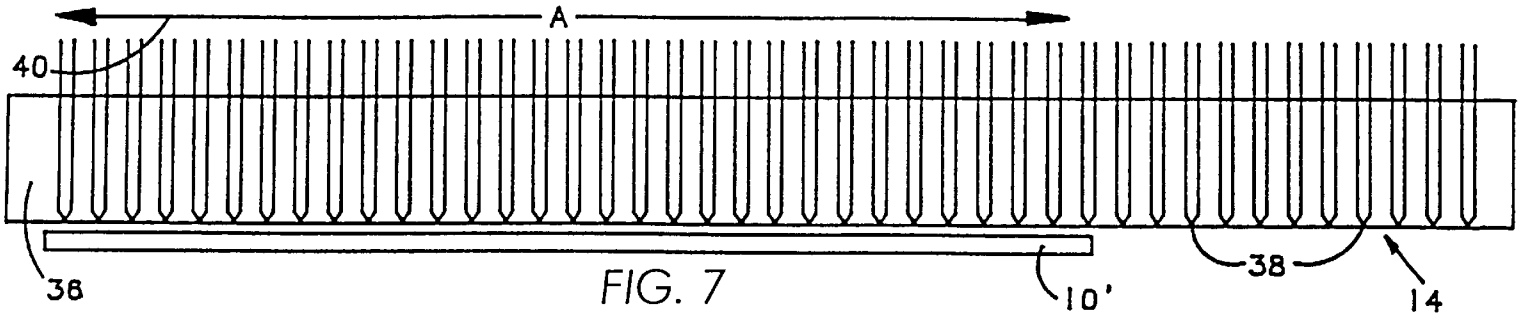
FIGS. 7–9 are simplified drawings of a thermal printhead divided in to sub-heads for printing on the labels of FIG. 5.
Figure 8:
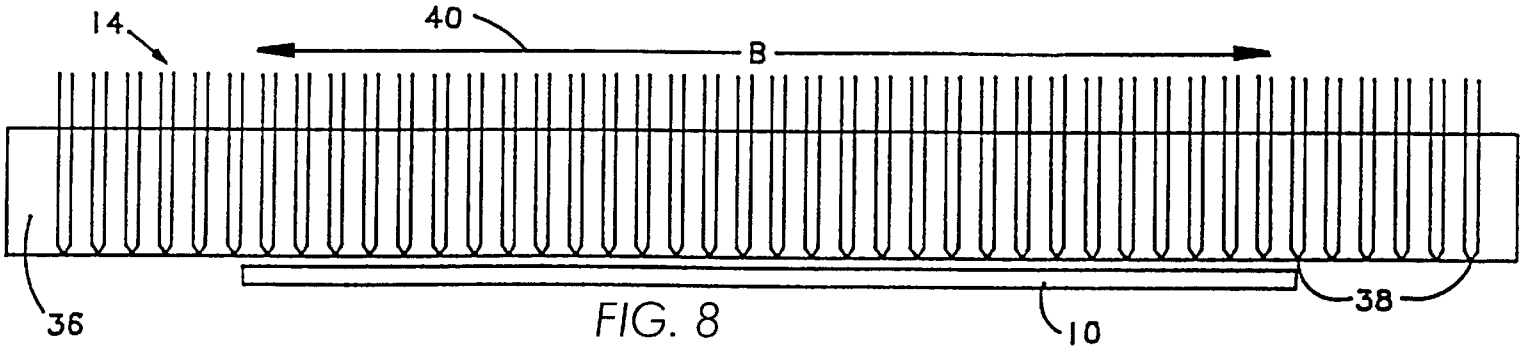
Figure 9:
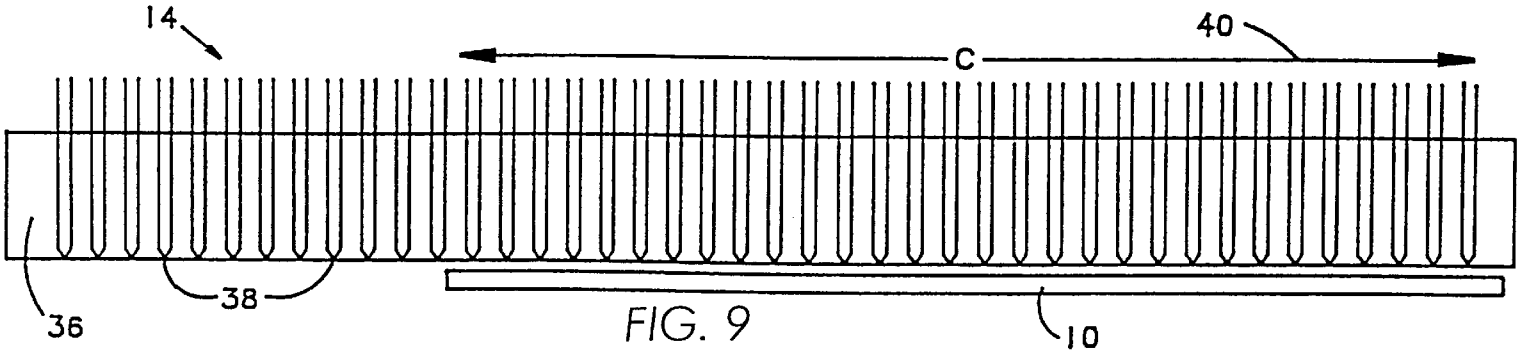

Returning now to block 6.4 with particularity, it will be noted that the block says that the logic 32' is to "PRINT LABEL WITH PROPER PORTION OF PRINTHEAD". A thermal printhead 14 to be used with the logic 32' of FIG. 6 is shown in FIGS. 7–9. As with the typical thermal printhead, the printhead 14 comprises a body 36 containing a plurality of linearly aligned, closely adjacent heating elements 38 that cause the actual printing of the pixel positions on the labels 10,10'. In this case, however, there are a number of heating elements 38 "N" which exceeds the number of pixel positions across one label 10,10'.

By way of example, the printhead 14 may be adapted to print a density of 300 dpi. That means that the body 36 contains 300 heating elements 38 in every inch of its length. Using the media 28" of FIG. 5 as an example, there are three labels 10',10 in each sequence. Further, assuming that each label 10',10 is one inch wide and that the labels are offset by one-quarter of an inch. Thus, the total width of the labels 10',10 is one and one-half inches. Therefore, the printhead 14 must include 450 heating elements 38 "N" (i.e., 1.5 inches×300 dpi).

According to the present invention, the printhead 14 is subdivided into three sub-printheads 40 each comprising 300 heating elements 38. Each of the three sub-printheads 40 is separately addressable as if it were a smaller printhead of 300 heating elements 38. The three sub-printheads 40 are depicted in FIGS. 7, 8, and 9, and labeled as "A", "B", and "C", respectively, and correspond to the "PROPER PORTION OF PRINTHEAD" language of block 6.4. In FIG. 7, sub-printhead "A" comprising the leftmost 300 heating elements 38 (as the figure is viewed) is being used to print on the first label 10' of the sequence of three. In FIG. 8, sub-printhead "B" comprising the centermost 300 heating elements 38 (as the figure is viewed) is being used to print on the second label 10 of the sequence of three. Finally, in FIG. 9, sub-printhead "C" comprising the rightmost 300 heating elements 38 (as the figure is viewed) is being used to print on the third label 10 of the sequence of three.

Figure 10:
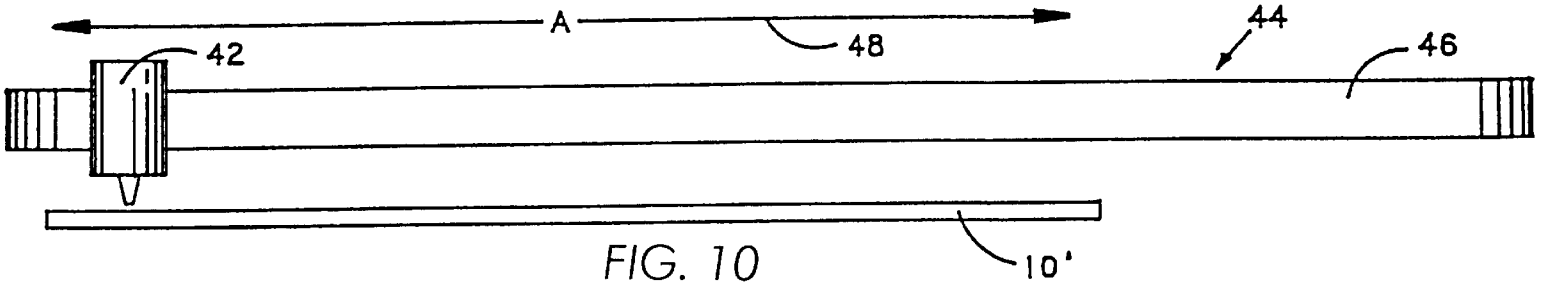
FIGS. 10–12 are simplified drawings of an impact printhead printing station divided in to sub-printing zones for printing on the labels of FIG. 5.
Figure 11:
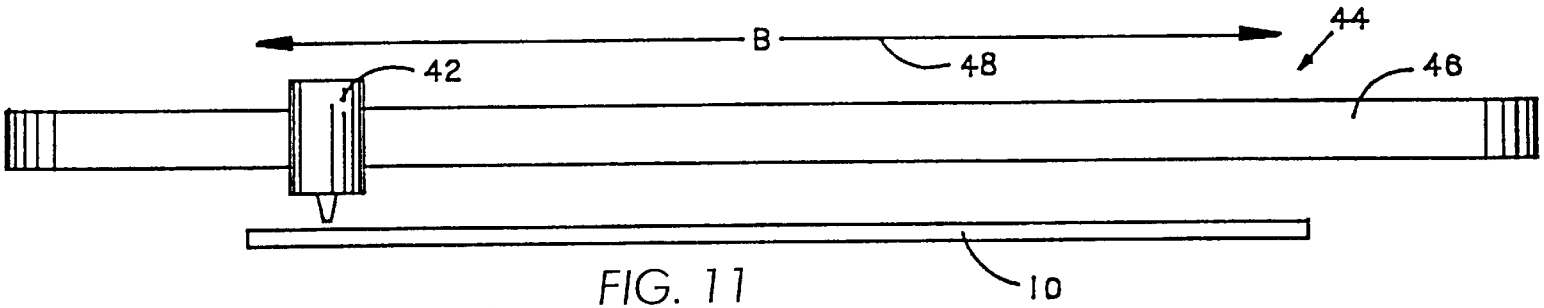
Figure 12:
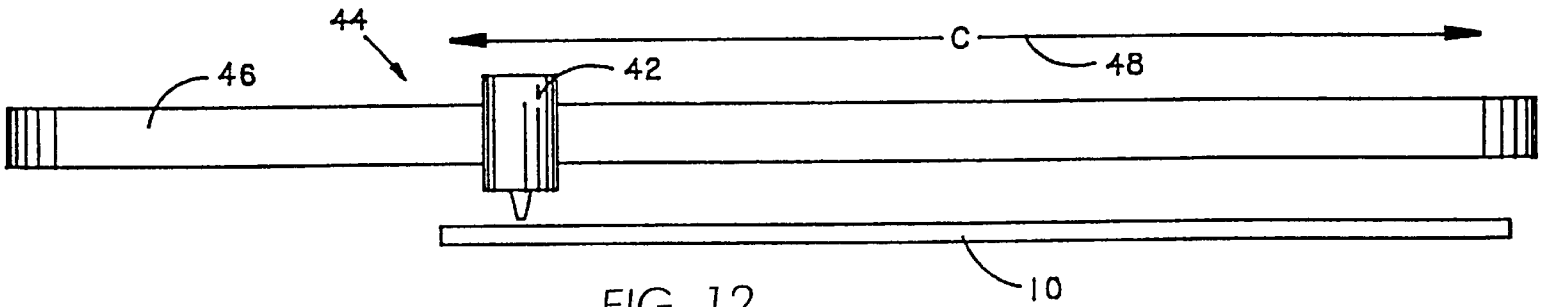

While a thermal printhead is preferred and the language of block 6.4 refers to printing with the proper portion of the printhead, it should be appreciated that the present invention is not limited to thermal printing and the above described language of block 6.4 should not be construed as limiting. Rather, it should be broadly construed as referring to any type of printing in which the print station is sub-divided into separate portions. In this regard, FIGS. 10–12 depict block 6.4 being implemented with an impact printhead 42. The impact printhead 42 is part of a printing station 44 that extends from one end of the drive belt 46 carrying the printhead 42 to the other. Alternatively, it would be apparent to one with ordinary skill in the art that the technique of using laterally staggered labels is also applicable for use with so-called ink-jet printing. With respect to the same example of FIG. 5 discussed above for the thermal printhead 14, the print station 44 is divided into three sub-print stations 48. The three sub-print stations 48 are depicted in FIGS. 10, 11 and 12 and labeled as "A", "B", and "C", respectively and are again used to illustrate the language of block 6.4. In FIG. 10, sub-print station "A" comprising the leftmost portion of the print station 44 (as the figure is viewed) is being used to print on the first label 10' of the sequence of three. In FIG. 11, sub-print station "B" comprising the centermost portion of the print station 44 (as the figure is viewed) is being used to print on the second label 10 of the sequence of three. Finally, in FIG. 12, sub-print station "C" comprising the rightmost portion of the print station 44 (as the figure is viewed) is being used to print on the third label 10 of the sequence of three. As with the thermal printhead 14, each of the sub-print stations 48 is separately addressable by the logic 32' just as if it were a smaller print station having a reduced printing width.

Figure 13:
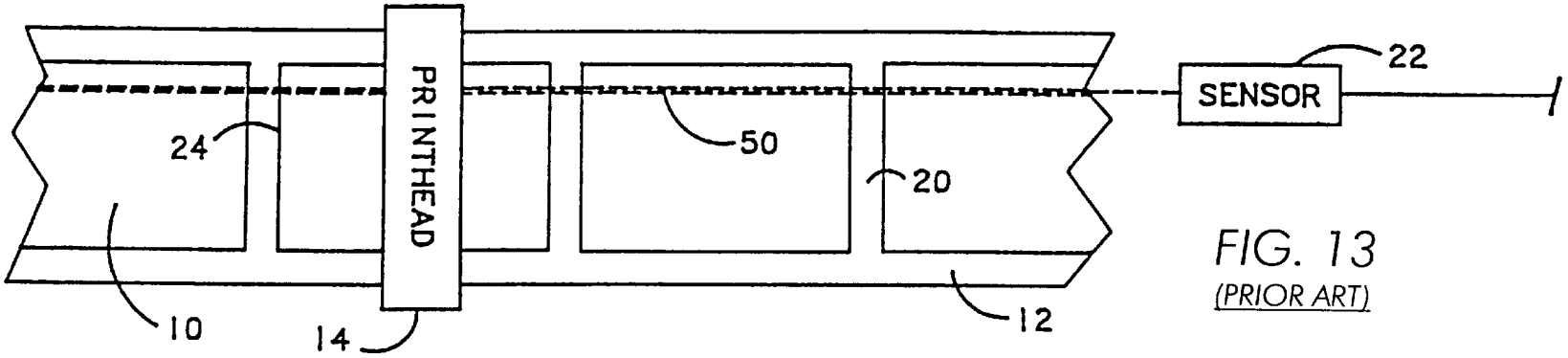
FIG. 13 (PRIOR ART)
FIG. 13 is a simplified drawing of a prior art approach to sensing label edges.
Figure 14:
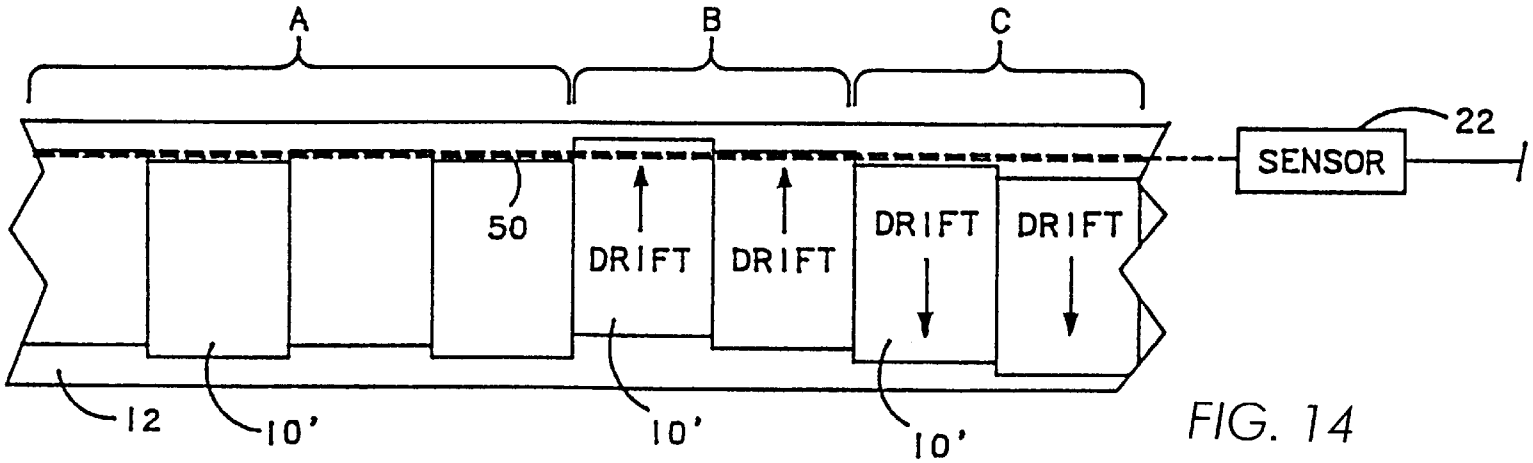
FIG. 14 is a simplified drawing depicting the effect of lateral drift when printing on staggered labels according to the present invention if the prior art sensing approach of FIG. 13 is employed.

In FIG. 13, the typical prior art manner of sensing gapped labels 10 is shown. The sensor 22 senses along a narrow path 50 looking for the leading edges 24 following the gaps 20. Since there is a gap 20 providing a long (laterally) leading edge 24 to sense, the path 50 can be more centrally located so that any lateral drift of the labels 10 is of no consequence. FIG. 14 depicts what would happen if the conventional prior art sensing approach of FIG. 13 were to be employed with staggered labels 10' according to the present invention where dynamic lateral drift is possible. The labels 10' in area "A" are properly located along the sensor path 50 so that the leading edge 24 of every other label 10' is sensed. In area "B", however, the labels 10' have drifted upward as the figure is viewed so that the path 50 crosses all labels 10' and no leading edges 24 are sensed after the first one. By contrast, in area "C" the labels 10' have drifted downward as the figure is viewed so that the path 50 no longer crosses any labels 10'.

A solution according to the present invention is shown in FIG. 15. The optical sensor 22' senses along a path 50' having a lateral beam width or sensing region with respect to the direction of movement of the labels 10' which is greater than the maximum distances of lateral drift. With the approach of FIG. 15, the critical sensing zone of the moving labels 10' is always in the sensing path 50' of the sensor 22' despite lateral tracking errors.

The drawback of the approach of FIG. 15 is that the sensor 22' is always seeing a blurry signal, i.e., a mix of the optical signals of the label 10', backing strip 12, and even the space off the edge of the backing strip 12. As the backing strip wanders laterally, the amplitude of the sensor signal changes. FIG. 16 illustrates in simplified form how the optical signal changes over the course of many labels 10' as the backing strip 12 gradually drifts laterally in the path of longitudinal movement. Since the label edge transitions are abrupt and the lateral drift is slow, it is possible to employ a sensing approach which detects sharp transitions such as the label edges 24 but ignores slow changes. The present invention as hereinafter described implements such an approach to solve this problem.

A typical label printer detects the edges of a label by detecting changes in the output 54 of the optical sensor 22. The printer's microprocessor 52 samples the optical sensor output 54 at regular small intervals of longitudinal motion of the labels. A mathematical algorithm implemented in the logic 56 of the microprocessor 52 determines whether the sensor 22 is seeing a label or a gap at each interval. For example, a simple algorithm compares the sensor output 54 with a pre-established threshold value and all sensor reading on one side of the threshold are considered to be labels. The simplest way to detect staggered labels would be to assume that a staggered label coincides with each detected gap. That method has a possible subtle performance problem. In practice, optical variables and rounded edges of labels can cause the sensor to measure labels consistently larger or smaller than they actually are. This error shifts the measured start of the detected label in one direction by a consistent amount, yet it shifts the measured start of the offset labels in the opposite direction. As a result, the printing is inconsistently positioned on the labels.

Where all the labels 10' are of the same size, this knowledge can be used to employ a more robust, and therefore preferred, algorithm as shown in FIG. 17. An assumption is validly made that (1) the gaps between sensed leading edges 24 are measured larger or smaller than their physical size; (2) the error is fairly consistent; and, (3) effects both edges of a gap evenly. After the microprocessor 52 detects the start and end of a label 10' and the end of the following gap, the logic 56 calculates the error compensation factor E using the equation of FIG. 17 and shifts the edges by that same amount so that the label and gap are the same size. In the algorithm of FIG. 17 for calculating the compensation factor E:

$$E = \frac{(B-A) - \frac{(C-A)}{2}}{2}$$

wherein:

A=position of a detected leading edge of a label;

B=position of a detected trailing edge of a label or a leading edge of an offset label; and C=position of a detected leading edge of a following label.

A corrected position for the leading edges of the labels may then be determined from the equations A'=A+E and B'=B−E, wherein:

A'=calculated leading edge of a label, after correction; and

B'=calculated leading edge of an offset label, after correction.

Figure 19:
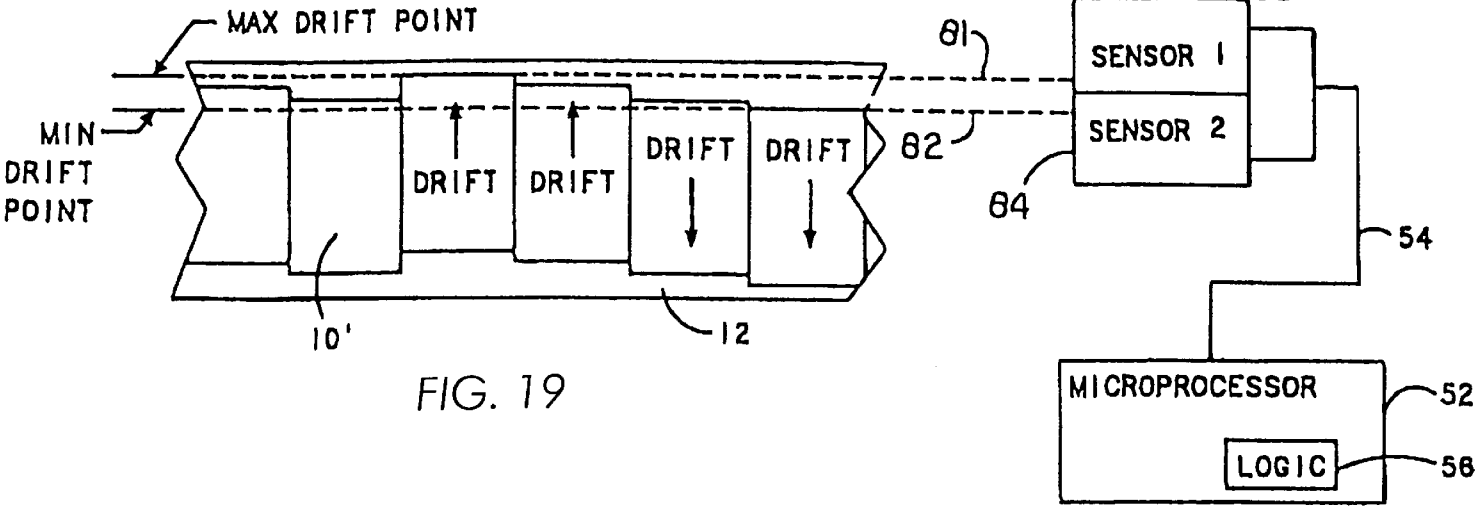
FIG. 19 is a simplified drawing of an alternative sensing approach for sensing staggered labels when lateral drift is possible.

FIG. 19 illustrates an alternative embodiment of the optical sensor of FIG. 15. Rather than utilizing a single sensor having a lateral beam width or sensing region with respect to the direction of movement of the labels 10' which is greater than the maximum distances of lateral drift, the embodiment of FIG. 19 utilizes two adjacent sensors 83, 84. The sensors 83, 84 are adapted to sense along two parallel sensing paths 81, 82 that correspond to the edge regions of the single sensing path 50'. The primary sensing path 81 would operate substantially as the conventional sensing path 50 described above, and the secondary sensing path 82 would be effective only for sensing labels 10' that have drifted laterally. Ordinarily, the secondary sensing path 82 would not detect any edges of the labels 10'; however, when there is lateral drift of a staggered label 10', the sensing path 82 would cross a label edge transition and would accordingly detect the edge. The edge information could then be derived from either the individual signals or the composite signal, and provided to the print and position logic in the same manner as described above.

To further improve the accuracy of the collected edge data, an even greater number of sensors may be utilized. The number of such sensors n would be defined from the equation $$n \geq 1 + \frac{D}{d_0},$$

where:

D=lateral tracking error; and $d_0$=stagger distance between adjacent labels.

By keeping $D<d_0$, two sensors could advantageously be utilized as illustrated in FIG. 19. The separation distance between the sensors must be greater than a maximum amount of the lateral tracking error D. It should be appreciated that it is advantageous to keep the number of sensors to a minimum so as to reduce the complexity of the printer. The signals from the plural sensors may be combined or summed to provide a composite signal that represents the single signal from the wide aperture sensor 22' of FIG. 15. The combining may be performed in software by adding the digitized outputs of the sensors, or in hardware by AC coupling the sensor outputs to filter the DC components and then by summing the resultant signals.

Figure 20:
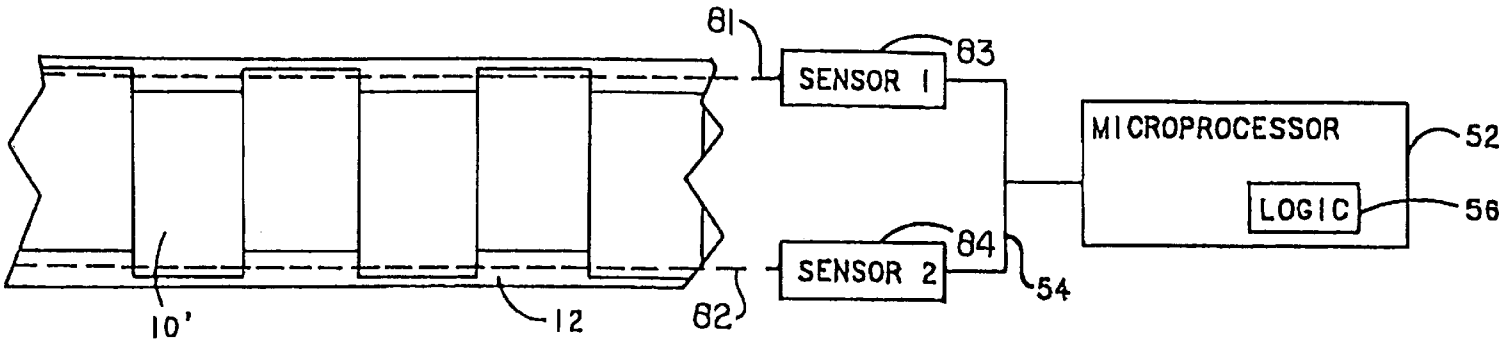
FIG. 20 is a simplified drawing of another alternative sensing approach for sensing staggered labels when lateral drift is possible.

FIG. 20 illustrates another alternative embodiment of the optical sensor of FIG. 15, which eliminates the above-described problem associated with assuming that staggered labels coincide with each detected gap. In the embodiment of FIG. 20, two sensors 83, 84 are utilized to sense along two parallel sensing paths 81, 82. Unlike FIG. 19, the secondary sensing path 82 is disposed at an opposite side of the labels opposite from the primary sensing path 81. The two sensors 83, 84 would operate in an alternating fashion, such that the first sensor 83 would detect labels 10' staggered upward (as seen in FIG. 20) and the second sensor 84 would detect labels 10' staggered downward (as seen in FIG. 20). The logic 56 would not have to assume that gaps coincide with staggered labels, since each label 10' would be sensed by one of the sensors 83, 84.

Figure 21:
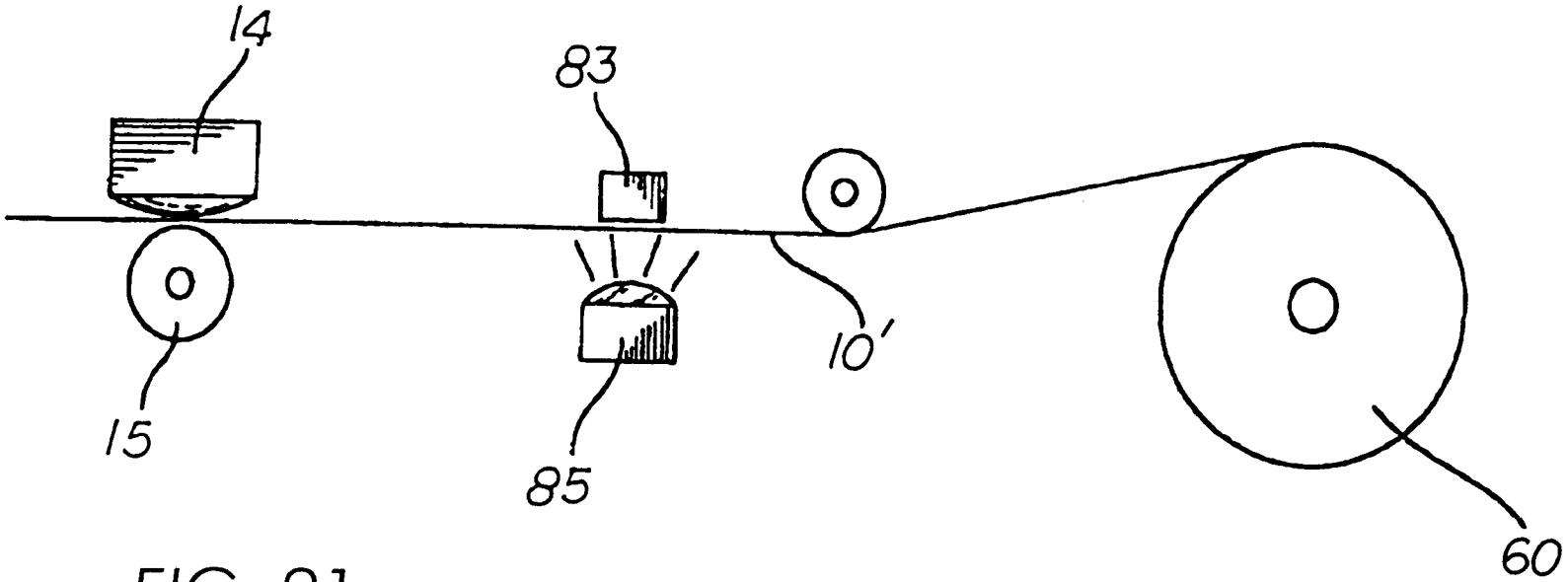
FIG. 21 is a simplified drawing of a label printing application having a sensor for detecting the staggered labels.

A simplified drawing of a printer is provided in FIG. 21. The staggered labels 10' of the media are drawn from a supply roll 60 to a print region defined between the printhead 14 and a platen 15. The sensor 83 (or 22) may comprise an optically sensitive element, such as a charge coupled device (CCD) disposed on one side of the media. A light source 85 disposed on the other side of the media provides illumination that transmits through the media and is detected by the sensor 83. The sensor 83 may further comprise a linear array of active elements that extend in a direction perpendicular to the direction of travel of the media. The light source 85 may be provided by various elements, such as an incandescent bulb or one or more light emitting diodes (LEDs). Though FIG. 21 illustrates the sensor 83 disposed above the media and the light source 85 below the media, it should be appreciated that the relative placement of these elements may be reversed. Moreover, it should be appreciated that the second sensor 84 may be disposed in the relative to the media in a similar manner. It should also be appreciated that other types of non-optical sensors could also be utilized, such as piezo-electric sensors that detect differences of the media thickness.

In a thermal printer, it is common to utilize a printer transport mechanism that can accommodate media of varying widths. The printer would ordinarily have a fixed edge guide at a first side of the transport path, and an adjustable edge guide at the other side of the transport path. With respect to the embodiments of FIGS. 19 and 20, the first sensor 83 may be coupled to the fixed edge guide and the second sensor 84 may be coupled to the adjustable edge guide. This way, as the adjustable edge guide is moved to accommodate different media sizes, the second sensor 84 will move in registration with the adjustable edge guide.

Figure 18:
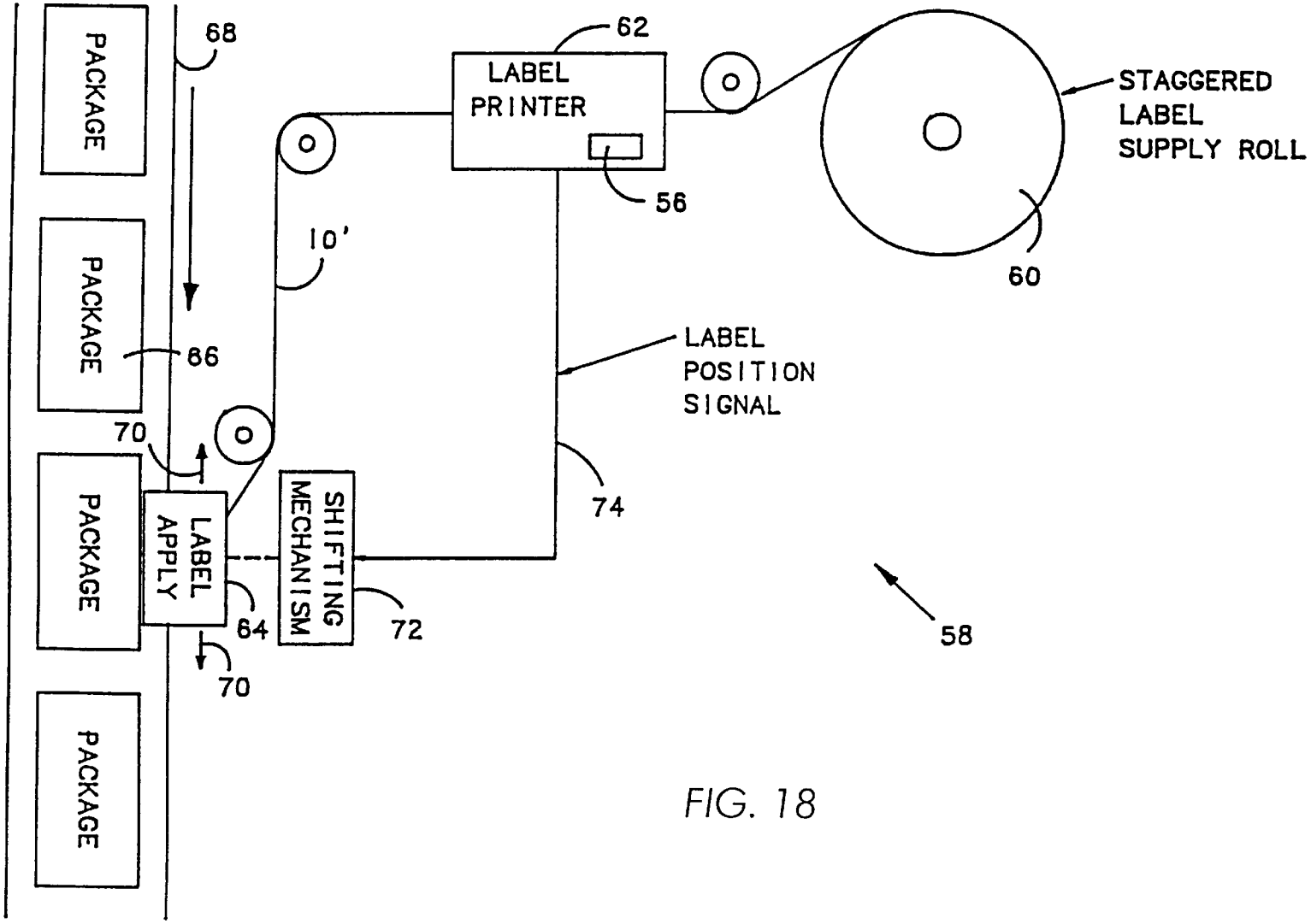
FIG. 18 is a simplified drawing of label printing and application apparatus according to the present invention for properly positioning labels that are laterally staggered.

When employing staggered labels according to the present invention, a further problem exists when they are employed in a system that both prints and applies the printed labels. Such a system 58 according to the present invention which takes care of this problem is depicted in FIG. 18. Staggered labels 10' from a supply roll 60 pass through a label printer 62 according to the present invention as described above. From there, they proceed to a label applying mechanism 64 which applies the labels 10' to packages 66 (or other objects) moving down a conveyor belt 68. While the applying part of the mechanism 64 is substantially conventional, unlike conventional applying mechanisms which are laterally positionally fixed, the applying mechanism 64 of the system 58 is mounted for lateral movement by at least the amount of label staggering as indicated by the arrows 70. The applying mechanism 64 is positionally driven by a shifting mechanism 72. The shifting mechanism 72 is driven by a coordinated position signal from the logic 56 within the printer 62. That is, the logic 56 is constantly determining the lateral position of each label 10' so that the printhead 14' of the label printer 62 prints at the proper lateral position each time despite the staggering of the labels 10'. Thus, the logic 56 knows the lateral position of the label 10' which is "N" labels from it at the label applying mechanism 64 and provides that information on line 74 connected to the shifting mechanism 72.

Having thus described a preferred embodiment of a gapless label media and printing apparatus, it should be apparent to those skilled in the art that certain advantages of the within system have been achieved. It should also be appreciated that various modifications, adaptations, and alternative embodiments thereof may be made within the scope and spirit of the present invention.

The invention is further defined by the following claims. What is claimed is:

1. A label printer/applier for printing label data on labels of a strip of label media having a plurality of laterally staggered labels in a plurality of sequences of the labels with a first label of each sequence of the labels having a leading edge which is sensible and thereafter applying printed labels on a surface at lateral positions corrected for staggering, the label printer/applier comprising:

a) a printhead for printing on the media;

b) at least one sensor sensing the leading edge of each first label at a known distance from said printhead;

c) a drive system moving the plurality of labels from a position of said at least one sensor to a pre-established print position under said printhead;

d) a label attaching mechanism receiving printed labels from said printhead, said label attaching mechanism being laterally movable a distance equal to an offset width of said common pattern of staggering;

e) a shifting mechanism having a signal input shifting said label attaching mechanism laterally a distance and amount dictated by a signal at said signal input; and, f) position and print logic, f1) for sensing each first label of each sequence of labels with said at least one sensor, f2) for moving a next in sequence label from said position of said at least one sensor to said pre-established print position under said printhead, f3) for printing label data on labels positioned under said printhead, and f4) for outputting a signal to said signal input indicating the lateral position of a label positioned at said label attaching mechanism for attachment to a surface whereby said label is properly positioned laterally on said surface to compensate for its lateral offset in said common pattern of staggering.

2. The label printer/applier of claim 1 wherein said at least one sensor senses along a path having a width greater than a maximum amount of lateral drift of the plurality of labels.

3. The label printer/applier of claim 1 wherein said position and print logic includes logic for calculating a compensation factor E according to the equation:

$$E = \frac{(B-A) - \frac{(C-A)}{2}}{2}$$

where:

A=position of a detected leading edge of a label;

B=position of a detected trailing edge of a label or a leading edge of an offset label; and C=position of a detected leading edge of a following label.

4. The label printer/applier of claim 3, wherein a corrected position for the leading edges of the labels may then be determined from the equations A'=A+E and B'=B−E, where:

A'=calculated leading edge of a label, after correction; and

B'=calculated leading edge of an offset label, after correction.

5. The label printer/applier of claim 1 wherein each sequence of labels is equally laterally staggered across a width of the strip of gapless label media in a common pattern of staggering so that the first label of each sequence of labels has at least a portion thereof creating an offset leading edge which is physically sensible and further comprising:

a) said printhead having a printing area extending across the width of the strip of gapless media; and, b) said printing area being subdivided into sub-printing areas equal to a width and positioned over a lateral position of one label of each sequence of labels.

6. The label printer/applier of claim 1 wherein:

a) said printhead is a thermal printhead having a plurality of adjacent heating elements across said printing area; and b) said sub-printing areas each comprises an equal number of adjacent ones of said heating elements.

7. The label printer/applier of claim 1 wherein:

a) said printhead is an impact printhead carried across a path defining said printing area from one end thereof to an opposite end; and, b) each of said sub-printing areas comprises a portion of said path.

8. The label printer/applier of claim 1 wherein said at least one sensor further comprises a plurality of sensors adapted to sense along parallel respective paths.

9. The label printer/applier of claim 1 wherein said parallel respective paths are separated by a distance greater than a maximum amount of drift of the plurality of labels.

10. The label printer/applier of claim 1 wherein signals from said plurality of sensors are combined into a common signal provided to said position and print logic.

11. The label printer/applier of claim 1 wherein at least one of said plurality of sensors is coupled to an adjustable edge guide of said printer.

12. The label printer/applier of claim 1 wherein said at least one sensor further comprises a charge coupled device.

13. Printing apparatus for a label printer printing label data on labels of a strip of label media having a plurality of laterally-staggered equal-sized labels in a plurality of sequences of the labels wherein each sequence of labels is equally laterally staggered across a width of the strip of label media in a common pattern of staggering so that the first label of each sequence of labels has at least a portion thereof creating an offset leading edge which is physically sensible, said printing apparatus comprising:

a) a printhead for printing on the media, said printhead having a printing area extending across the width of the strip of gapless media, said printing area being subdivided into sub-printing areas equal to a width and positioned over a lateral position of one label of each sequence of label; and, b) position and print logic, b1) for sensing each first label of each sequence of labels with said sensor, b2) for calculating the lateral position of a label at a pre-established print position under said printhead, and b3) for employing a one of said sub-printing areas of said printhead associated with said lateral position to print label data on said label under said printhead.

14. The printing apparatus for a label printer of claim 13 wherein:

a) said printhead is a thermal printhead having a plurality of adjacent heating elements across said printing area; and, b) said sub-printing areas each comprises an equal number of adjacent ones of said heating elements.

15. The printing apparatus for a label printer of claim 13 wherein:

a) said printhead is an impact printhead carried across a path defining said printing area from one end thereof to an opposite end; and, b) each of said sub-printing areas comprises a portion of said path.

16. Sensing apparatus for a label printer printing label data on labels of a strip of label media having a plurality of laterally-staggered equal-sized labels in a plurality of sequences of the labels wherein each sequence of labels is equally laterally staggered across a width of the strip of label media in a common pattern of staggering so that the first label of each sequence of labels has at least a portion thereof creating an offset leading edge which is physically sensible, said sensing apparatus comprising:

at least one sensor sensing transverse edges of labels in the common pattern of staggering at a known distance from said printhead.

17. The sensing apparatus for a label printer of claim 16, wherein said at least one sensor senses along a path having a width greater than a maximum amount of lateral drift of the plurality of labels.

18. The sensing apparatus for a label printer of claim 16 wherein said at least one sensor further comprises a plurality of sensors adapted to sense along parallel respective paths.

19. The sensing apparatus for a label printer of claim 18 wherein said parallel respective paths are separated by a distance greater than a maximum amount of drift of the plurality of labels.

20. The sensing apparatus for a label printer of claim 16 and additionally including logic for calculating a compensation factor E used in association with edge positions sensed by said sensor according to the equation:

$$E = \frac{(B - A) - \frac{(C - A)}{2}}{2}$$

where:

A=position of a detected leading edge of a label;

B=position of a detected trailing edge of a label or a leading edge of an offset label; and C=position of a detected leading edge of a following label.

21. The sensing apparatus for a label printer of claim 17, wherein a corrected position for the leading edges of the labels may then be determined from the equations: A'=A+E and B'=B−E, where:

A'=calculated leading edge of a label, after correction; and

B'=calculated leading edge of an offset label, after correction.

22. A label printer for printing label data on labels of a strip of label media having a plurality of laterally-staggered equal-sized labels in an alternating sequence of the labels wherein each one of said labels has at least a portion thereof creating an offset leading edge which is physically sensible, said label printer comprising:

a) a printhead for printing on the media, said printhead having a printing area extending across the width of the strip of gapless media, said printing area being subdivided into sub-printing areas equal to a width and positioned over a lateral position of one of said labels of each said sequence of labels;

b) a first sensor sensing the leading edge of each alternating one of said labels at a known distance from said printhead;

c) a second sensor sensing the leading edge of each other alternating one of said labels at a known distance from said printhead;

d) a drive system moving the plurality of labels from a position of said first and second sensors to a pre-established print position under said printhead; and, e) position and print logic, e1) for sensing each label in an alternating manner with said first and second sensors, e2) for moving a next in sequence label from said position of said first and second sensors to said pre-established print position under said printhead, and e3) for printing label data on labels positioned under said printhead.

23. The label printer of claim 22 wherein at least one of said first and second sensors is coupled to an adjustable edge guide of said printer.

24. The label printer of claim 22 wherein each of said first and second sensors further comprises a charge coupled device.

* * * * *